US005601444A

United States Patent [19]

Cox

[11] Patent Number: 5,601,444

[45] Date of Patent: Feb. 11, 1997

[54] APPARATUS FOR SECURING A RIBBON CABLE PLUG TO A PRINTED CIRCUIT BOARD CONNECTOR

[75] Inventor: Alvin E. Cox, Yukon, Okla.

[73] Assignee: Seagate Technology, Inc., Scotts Valley, Calif.

[21] Appl. No.: 517,905

[22] Filed: Aug. 22, 1995

[51] Int. Cl.[6] ..... H01R 13/62

[52] U.S. Cl. ..... 439/299; 439/148

[58] Field of Search ..... 439/148, 149, 439/296, 299, 300, 315, 131, 133

[56] References Cited

U.S. PATENT DOCUMENTS

| | | | |
|---|---|---|---|
| 4,197,945 | 4/1980 | Sherwood | 439/149 |
| 5,026,295 | 6/1991 | Fong et al. | 439/149 |
| 5,242,311 | 9/1993 | Seong | 439/149 |
| 5,320,542 | 6/1994 | Cheng | 439/148 |
| 5,320,543 | 6/1994 | Barton | 439/148 |

*Primary Examiner*—David L. Pirlot
*Assistant Examiner*—Jill Demello
*Attorney, Agent, or Firm*—Bill D. McCarthy; Edward P. Heller, III; Randall K. McCarthy

[57] ABSTRACT

An apparatus for securing a ribbon cable plug to a 3-in-1 printed circuit board connector. The ribbon cable plug mates with a signals section of the connector and an address section of the printed circuit board connector, adjacent the signal section, includes a plurality of pins that extend from the connector parallel to a line along which the ribbon cable plug is moved to mate the ribbon cable plug with the signals section of the connector. The pins, which have square cross sections, are received in circular sockets formed in one end to a body member of a retaining plug constructed of glass filled polyester. The sockets are sized so that the pins will deform portions of the retaining plug body member about the sockets and thereby clamp the retaining plug to the printed circuit board connector. A tongue is formed on the retaining plug body member, at the distal end thereof, and projects from one side of the retaining plug body member to overlay the distal end of a ribbon cable plug that has been mated with the printed circuit board connector.

8 Claims, 2 Drawing Sheets

APPARATUS FOR SECURING A RIBBON CABLE PLUG TO A PRINTED CIRCUIT BOARD CONNECTOR

BACKGROUND OF THE INVENTION

1. Field of the Invention

The present invention relates generally to devices for securing electrical plugs to connectors with which the plugs are mated and, more particularly, but not by way of limitation to devices for securing ribbon cable plugs to printed circuit board connectors.

2. Brief Description of the Prior Art

Computer systems are put together using a variety of peripherals which are selectable by the user to tailor the system to his personal needs. Once the peripherals have been selected and, if required, mounted in the computer case, they are electrically integrated into the system via a system bus which provides communications between various parts of the system including a microprocessor which controls the operation of the system as a whole. For example, disc drives are commonly integrated into a computer system via a controller card that mounts in an expansion slot that provides connections to the system bus. The disc drive proper is then connected to the controller card via a ribbon cable upon which is mounted a multi-pin plug that is mated with a connector on a printed circuit board mounted on the disc drive case.

While the use of a ribbon cable to make electrical connections to a disc drive or other peripheral device in this manner is generally problem free under normal operating conditions, it has been found that problems can arise in abnormal circumstances. In particular, repeated mechanical shocks delivered to a computer, for example, during transport, can result in a ribbon cable plug "walking" off a printed circuit board connector; that is, the plug is jarred loose from the connector in a series of small steps. The general result is that the computer will no longer be operable for its intended purpose. Again, for example, if the plug mates with a connector on a disc drive, programs and data will not be available when an attempt is subsequently made to place the computer in service.

While, conceptually, the problem of unmating might be solved by increasing the force necessary to unmate the ribbon cable plug and printed circuit board connector, such an increase would present new problems. The mating is commonly effected by forcing pins on the plug into sockets formed in the connector so that frictional forces hold the plug and connector together once the two have been mated. While these frictional forces can be made as large as one wishes, the result of doing so may very will be damage to the pins and sockets. As will be clear to those of skill in the art, a large number of connections will generally be made to the system bus in a limited space with the result that the pins and sockets tend to have limited mechanical strength. Consequently, both the mounting of the plug and, should it be necessary for testing for example, the removal of the plug can give rise to damage to the pins and the sockets if the mating forces between them are large. Thus, increasing the mating force is not an attractive solution to the problem. Moreover, the connector may be mounted on the printed circuit board by solder joints between contacts in the board and in the connector and these joints can be damaged by large forces exerted on the contacts in mating the plug and the connector.

Another possibility for solving the problem would be the use of some type of clip that would fit over the ribbon cable plug and attach to the printed circuit board connector. A problem with this approach is the length that would be required for the clip and a need to secure the clip to the connector at the ends of the clip. Since the ribbon cable extends from one side of the plug, a securing clip would have to extend along the long axis of the plug, at least the width of the ribbon cable, to clear the ribbon cable and the cable would interfere with connections between the clip and connector that might be made along the length of the clip.

The problem is exacerbated where the printed circuit board connector is a so-called 3-in-1 connector which is commonly used to make electrical connections to a disc drive. This type of connector is comprised of a signals section, which mates with the ribbon cable plug leading to the system bus, an address section by means of which the disc drive can be addressed for use, and a power section by means of which power is supplied to the disc drive from the computer power supply. These sections are placed side-by side so that the connector can be mounted along an edge of the printed circuit board which supports circuitry used in the operation of the disc drive. As a result, a suitable clip for securing the ribbon cable connector to the printed circuit board connector would have to have a width substantially equal to the width of the printed circuit board and would have to be secured to the connector at its ends. While such a securing device might be constructed, doing so would generally require the use of metal parts which not only could give rise to short circuits but, since the device would be secured to the connector at widely spaced points, would entail shaping operations that could give rise to undesirable manufacturing expenses. Consequently, prior to the present invention, no really suitable means has been developed to secure ribbon cable plugs to printed circuit board connectors.

SUMMARY OF THE INVENTION

The present invention provides an inexpensive but effective system for securing a ribbon cable plug to a printed circuit board connector that is especially useful where the connector is a 3-in-1 connector but can also be used with other types of connectors. In the case of the 3-in-1 connector, the invention exploits a redundancy that is often found in disc drive electrical connection systems or can be easily provided. This redundancy is the duplication of the address section of the 3-in-1 connector in a separate connector that can be mounted at a location on the printed circuit board that is more convenient than immediately adjacent the signals section of the 3-in-1 connector. Thus, the address section of the 3-in-1 connector can be freed for purposes other than making electrical connections.

Thus, in one aspect of the present invention, the invention is a retaining plug that can be mounted on the address section of a 3-in-1 connector to secure a ribbon cable plug mounted on the signals section of the connector. To this end, the retaining plug is comprised of a body member having a tongue projecting laterally from the body member at one end of the body member so that the tongue can overlay the end of the ribbon cable plug and prevent the plug from being jarred loose from the connector. Sockets formed in the opposite end of the body member mate with, and grip, pins of which the address section of the 3-in-1 connector is comprised to secure the retaining plug to the connector.

Since the address section will not be used for electrical connections and since, in general, robust pins are used in the address sections of available 3-in-1 connectors, the forces with which the retaining plug can be made to grip these pins is for all practical purposes unlimited. Thus, the retaining plug can be secured to the address section of the 3-in-1 connector by selecting a gripping force that will exceed any foreseeable forces on the retaining plug that would tend to dislodge the retaining plug from the address section of the connector. The gripping force can be selected by selection of the material of which the retaining plug is constructed and configuration of the sockets in the retaining plug to result in deformation of portions of the plug surrounding the sockets when the retaining plug is mounted on the connector. In particular, the invention contemplates that the retaining plug will be constructed of a organic polymer that will not only permit the sockets to firmly grip the pins but will also eliminate the danger of the retaining plug forming a short circuit and limit manufacturing costs for the retaining plug.

In a second aspect of the invention, the retaining plug is but one part of a combination which includes a means for mounting the retaining plug on the printed circuit board to cause the tongue to overlay the end of the ribbon cable plug. This second element of the combination can be the pins of the address section of a 3-in-1 connector and the retaining plug can be provided with sockets that receive these pins as described above. However, the mounting means is not so limited; rather, this second aspect of the invention contemplates that the retaining plug can be secured to the printed circuit board not only by the pins of the address section of a 3-in-1 connector and sockets formed in the body member of the retaining plug but by any structure that is equivalent to the combination of retaining plug and the address section of a 3-in-1 connector.

An important object of the present invention is to eliminate the danger that a ribbon cable plug might be jarred loose from a printed circuit board connector in a computer as the result of repeated shocks received by the computer during transport.

A second object of the invention is to provide an apparatus for securing a ribbon cable plug to a printed circuit board connector that is readily and inexpensively manufactured.

Yet a third object of the invention is to prove an inexpensive ribbon cable plug securing apparatus that can be used with existing printed circuit board connectors.

Other objects, features and advantages of the present invention will become apparent from the following detailed description when read in conjunction with the drawings and appended claims.

DESCRIPTION OF THE PREFERRED EMBODIMENT

Figure 1:
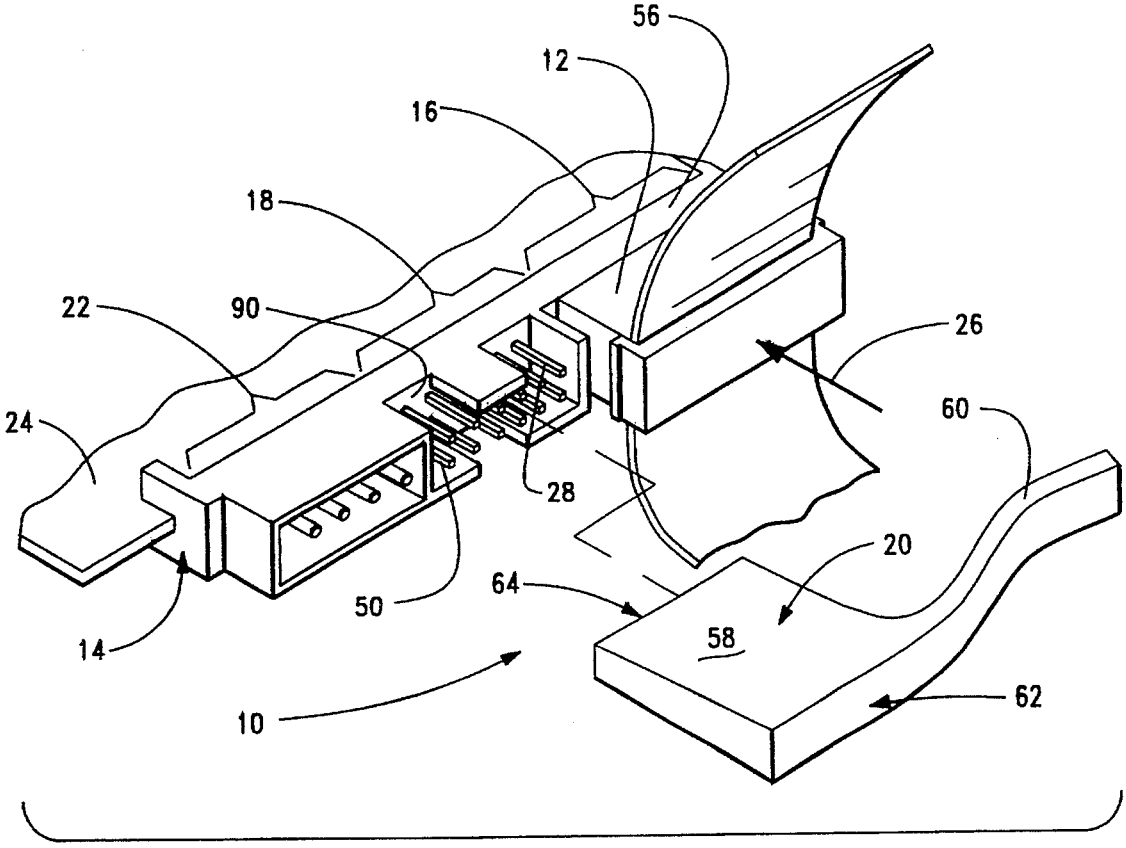
FIG. 1 is an exploded, isometric view of a ribbon cable plug securing apparatus constructed in accordance with the present invention to secure a ribbon cable plug to a 3-in-1 printed circuit board connector.

Referring now to the drawings in general and to FIG. 1 in particular, shown therein and designated by the general reference number 10 is a ribbon cable plug securing apparatus constructed in accordance with the present invention. In order to provide a concrete example that will facilitate an understanding of the invention, FIG. 1 has been drawn for the case in which a ribbon cable plug 12 is to be mounted on a printed circuit board connector 14 of the 3-in-1 type that is commonly used in disc drives. However, as noted above, the apparatus 10 can be used with substantially any type of printed circuit board connector so that the illustration of the connector 14 as a 3-in-1 connector is for exemplary purposes only and is not intended to be limiting.

As is known in the art, a 3-in-1 printed circuit board connector is comprised of three sections that are arranged in a row as shown in FIG. 1. Thus, the connector 14 comprises: a signals section 16 with which the ribbon cable plug 12 is mounted by insertion of pins (not shown) on the plug 12 into sockets (not shown) formed in the signal section 16; an address section 18 which, in the practice of the present invention, is used to secure a retaining plug 20 of the apparatus 10 to the connector 14 as will be discussed below; and a power section 22 which is used to transmit electrical power to electrical components mounted on a printed circuit board 24 which supports the connector 14.

Figure 3:
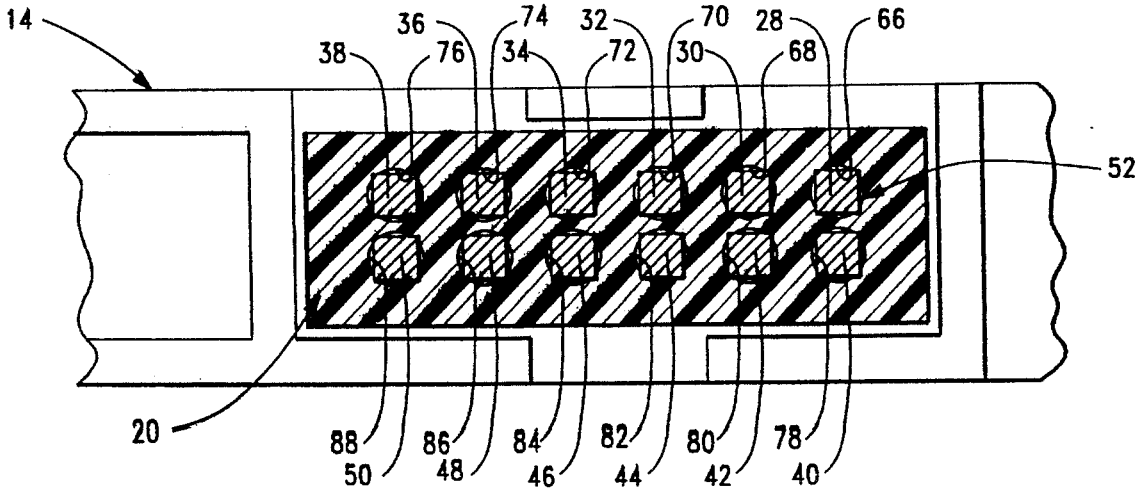
FIG. 3 is a cross section of the retaining plug and the pins of the retaining plug mounting means taken along line 3—3 of FIG. 2.
Figure 2:
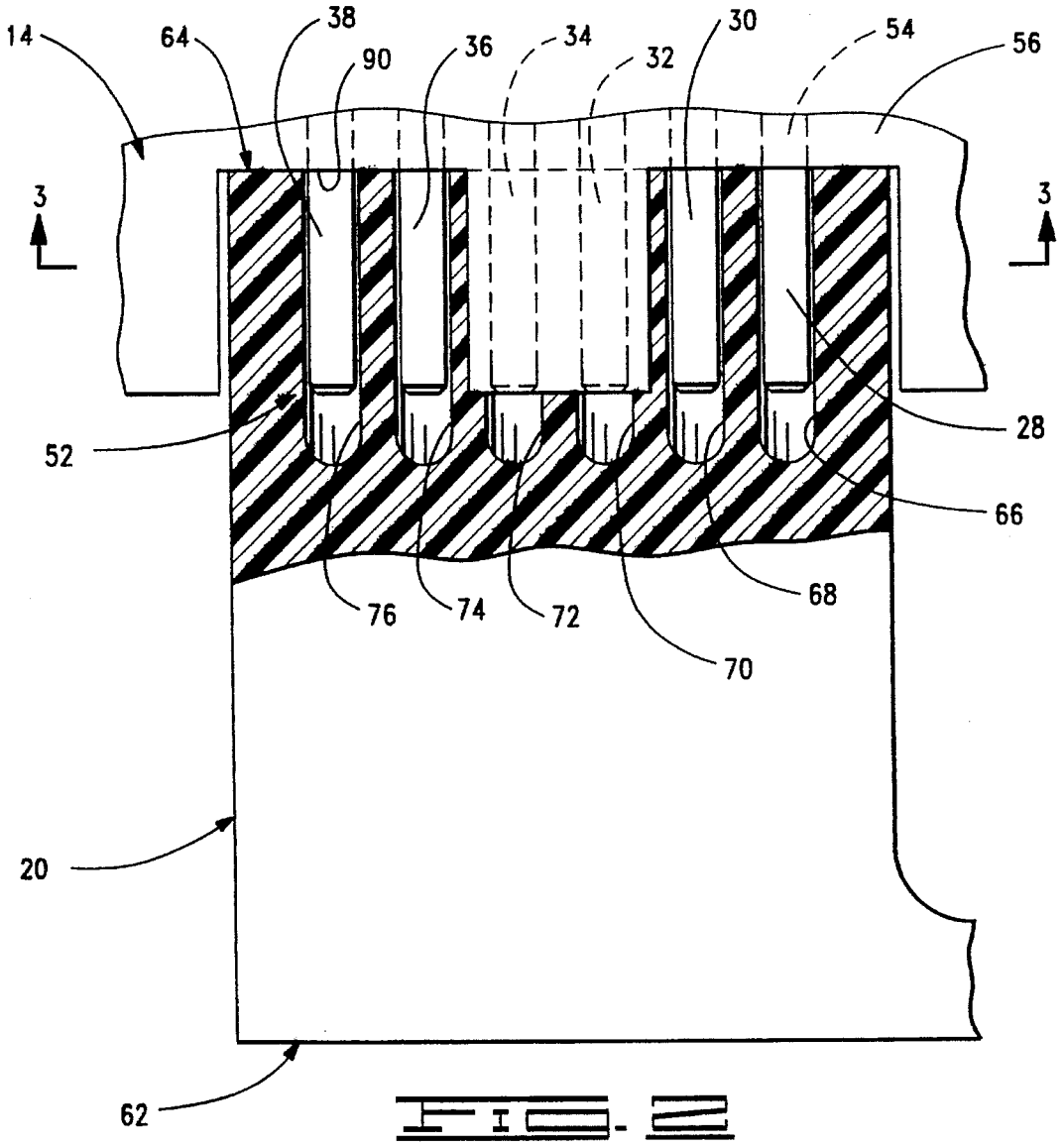
FIG. 2 is an enlarged, fragmentary top view in partial cross section of the retaining plug and portions of the printed circuit board connector used in mounting the retaining plug on the connector.

As is also known in the art, the sockets (not shown) in the signals section 16 extend generally along a line, indicated at 26 in FIG. 1, along which the ribbon cable plug 12 is moved to mate with the signals section 16 of the connector 14 and the address section is comprised of a plurality of pins 28, 30, 32, 34, 36, 38, 40, 42, 44, 46, 48 and 50 which, when the invention is practiced in conjunction with a 3-in-1 printed circuit board connector, form a portion of a mounting assembly, generally designated at 52 in FIGS. 2 and 3, used to secure the retaining plug 20 to the connector 14 as will be discussed below. (For clarity of illustration, only the pins 28 and 50 have been numerically designated in FIG. 1.) As shown in FIG. 2, portions of the pins 28, 30, 32, 34, 36, 38, 40, 42, 44, 46, 48 and 50, such as the portion 54 of the pin 28, are embedded in a plastic body portion 54 of the connector 14 and extend therefrom along lines that parallel the ribbon cable plug approach line 26 for a purpose to be discussed below.

As indicated above, the ribbon cable plug securing apparatus 10 is comprised of the retaining plug 20 to which attention is now invited. As shown in FIG. 1, the retaining plug 20 comprises a body member 58 and an integral tongue 60 which projects laterally from the body member at a distal end 62 of the body member. As will be discussed more fully below, the retaining plug 20 is mounted on the printed circuit board connector 14 at a proximal end 64 of the body member 58 so that the tongue 60 will extend generally parallel to the body portion 56 of the connector 14.

In the practice of the invention, the retaining plug 20 is constructed of a material that comprises an organic polymer with a preferred material being a glass reinforced polyester such as polybutylene teraphthalate. More particularly, a material that is well suited for construction of the retaining plug 20 is VALOX® DR 48 15% glass reinforced polybutylene teraphthalate resin available from General Electric Plastics of Pittsfield, Md. Such material combines flexibility with strength that permits the retaining plug to be deformed for mounting of the retaining plug on the pins 28, 30, 32, 34, 36, 38, 40, 42, 44, 46, 48 and 50 of the address section 18 of the connector 14 in a manner that has been illustrated in FIGS. 2 and 3.

Referring to FIGS. 2 and 3, the retaining plug mounting assembly 52, in addition to being comprised of the pins 28, 30, 32, 34, 36, 38, 40, 42, 44, 46, 48 and 50, is further comprised of a plurality of sockets 66, 68, 70, 72, 74, 76, 78, 80, 82, 84, 86 and 88 that are formed in the proximal end 64 of the retaining plug body member 58 at relative locations such that the sockets 66, 68, 70, 72, 74, 76, 78, 80, 82, 84, 86 and 88 will align with the pins 28, 30, 32, 34, 36, 38, 40, 42, 44, 46, 48 and 50 so that the retaining plug 20 can be mounted on the connector 14 by forcing the sockets 66, 68, 70, 72, 74, 76, 78, 80, 82, 84, 86 and 88 about the pins 28, 30, 32, 34, 36, 38, 40, 42, 44, 46, 48 and 50.

In order to provide a strong grip by the sockets 66, 68, 70, 72, 74, 76, 78, 80, 82, 84, 86 and 88 on the pins 28, 30, 32, 34, 36, 38, 40, 42, 44, 46, 48 and 50 that will prevent the retaining plug 20 from being jarred loose from the connector 14, the sockets are configured with respect to the pins to form an interference fit with the pins; that is, a fit that can be achieved only by deforming portions of the retaining plug body member 58 about the sockets 66, 68, 70, 72, 74, 76, 78, 80, 82, 84, 86 and 88. A particularly useful manner of forming the interference fit has been illustrated in FIG. 3 for the case in which the retaining plug 20 is mounted on the address section 18 of a 3-in-1 plug connector commonly used in making electrical connections to a disc drive. In such connector, the pins 28, 30, 32, 34, 36, 38, 40, 42, 44, 46, 48 and 50 have square cross sections that are nominally 0.020 inch on the side. An interference fit can be effected by forming the sockets 66, 68,70, 72, 74, 76, 78, 80, 82, 84, 86 and 88 as round holes having diameters that are less than the diagonal of the pin cross section. In particular, a suitable diameter for the sockets where the pins have 0.020 inch sides is 0.024 inch. The diagonals of the pins in such case will be approximately 0.028 inch so that corners of the pins will deform portions of the retaining plug body member 58 about the sockets substantially as has been illustrated in FIG. 3, to cause the retaining plug 20 to tightly grip the pins 28, 30, 32, 34, 36, 38, 40, 42, 44, 46, 48 and 50.

Returning to FIG. 1, it will be noted that the tongue 60 is an arcuate strip shaped to conform to a curve that is convex toward the printed circuit board connector 14 at such times that the retaining plug is mounted on the connector 14 by forcing the sockets 66, 68, 70, 72, 74, 76, 78, 80, 82, 84, 86 and 88 over pins 28, 30, 32, 34, 36, 38, 40, 42, 44, 46, 48 and 50 to abut the proximal end 64 of the retaining plug body member 58 against a face 90 on the address section 18 of the connector 14. As is known in the art, ribbon cable plugs 12 may extend differing distances from the connector 14 and the above described structure of the tongue 60 permits flexing that will enable the present invention to secure ribbon cable plugs of various sizes to a printed circuit board connector.

To use the present invention to secure a ribbon cable plug to a printed circuit board connector, the ribbon cable plug is first mounted on the printed circuit board connector in the usual manner. The retaining plug 20 is then oriented to align the tongue 60 with the ribbon cable plug 12 and the sockets 66, 68, 70, 72, 74,76, 78, 80, 82, 84, 86 and 88 are forced onto the pins 28, 30, 32, 34, 36, 38, 40, 42, 44, 46, 48 and 50 to mount the retaining plug 20 on the address section 18 of the connector 14 and thereby secure the ribbon cable plug 12 to the connector 14.

It will be clear that the present invention is well adapted to carry out the objects and attain the ends and advantages mentioned as well as those inherent therein. While a presently preferred embodiment has been described for purposes of this disclosure, numerous changes may be made which will readily suggest themselves to those skilled in the art and which are encompassed in the spirit of the invention disclosed and as defined in the appended claims.

What is claimed is:

1. An apparatus for securing a ribbon cable plug to a printed circuit board connector, comprising:

a retaining plug constructed of a material comprising an organic polymer, the retaining plug comprising a body member having an integral tongue projecting laterally from the body member at one end of the body member; and retaining plug mounting means, formed partially on the printed circuit board connector and partially on the opposite end of the retaining plug, for mounting the retaining plug on the printed circuit bard connector so as to extend the tongue of the retaining plug across the distal end of the ribbon cable plug at such times that the ribbon cable plug is mated with the printed circuit board connector.

2. The apparatus of claim 1 wherein the tongue is further characterized as an arcuate strip extending from the body member along a curve selected such that the tongue will be convex toward the printed circuit board connector at such times that the retaining plug is mounted on the printed circuit board connector.

3. The apparatus of claim 1 wherein the retaining plug mounting means comprises a plurality of pins having portions embedded in portions of the printed circuit board connector to one side of portions of the connector that mate with the ribbon cable plug, said pins extending from the connector parallel to a line along which the ribbon cable plug is moved to mate the ribbon cable plug with the printed circuit board connector, and a plurality of sockets formed in the body member of the retaining plug at said opposite end thereof to receive said pins; and wherein the sockets in the retaining plug are configured in relation to the plug mounting pins such that the pins will deform portions of the retaining plug about the sockets at such times that the retaining plug is mounted on the connector member.

4. The apparatus of claim 3 wherein said pins are characterized as having a square cross section and wherein the sockets in the retaining plug are characterized as circular holes having an undeformed diameter smaller than the diagonal of the pin cross section.

5. The apparatus of claim 3 wherein the retaining plug is further characterized as being constructed of glass reinforced polyester.

6. A retaining plug for securing a ribbon cable plug to a printed circuit board connector, wherein the printed circuit board connector is characterized as having a section for mating with the ribbon cable plug and a plurality of pins, located to one side of said section, extending parallel to a line along which the ribbon cable plug is moved to mate with said section of the connector, the retaining plug comprising:

a body member; and a tongue formed integrally with the body member and projecting laterally from the body member at one end of the body member;

wherein the retaining plug is constructed of a material comprising an organic polymer; and wherein a plurality of sockets, configured to grip said pins, are formed in the end of the body member opposite the end from which the tongue projects, whereby the retaining plug can be mounted on the printed circuit board connector via said pins and sockets to extend the tongue across the distal end of a ribbon cable plug mounted on the printed circuit board connector and thereby secure the ribbon cable plug to the printed circuit board connector.

7. The retaining plug of claim 6 wherein the retaining plug is further characterized as being constructed of glass reinforced polyester.

8. The retaining plug of claim 6 wherein the tongue is further characterized as extending from the body member along a curve selected such that the tongue will be convex toward the printed circuit board connector at such times that the retaining plug is mounted on the printed circuit board connector via said pins and sockets.

* * * * *

UNITED STATES PATENT AND TRADEMARK OFFICE

CERTIFICATE OF CORRECTION

PATENT NO. : 5,601,444
DATED : February 11, 1997
INVENTOR(S) : Alvin E. Cox

It is certified that error appears in the above-indentified patent and that said Letters Patent is hereby corrected as shown below:

Column 3, line 14, delete "a" and insert --an--.

Column 6, line 12, delete "bard" and insert --board--.

Signed and Sealed this

Nineteenth Day of August, 1997

*Attest:*

*Attesting Officer*

BRUCE LEHMAN

*Commissioner of Patents and Trademarks*